United States Patent [19]

Beucher

[11] Patent Number: 4,876,443

[45] Date of Patent: Oct. 24, 1989

[54] PHOTOCELL, HAVING INCLINED PLATE CATHODE

[75] Inventor: Josef Beucher, Hochstadt, Fed. Rep. of Germany

[73] Assignee: GTE Sylvania Licht GmbH, Erlangen, Fed. Rep. of Germany

[21] Appl. No.: 193,962

[22] Filed: May 13, 1988

[30] Foreign Application Priority Data

May 13, 1987 [DE] Fed. Rep. of Germany ..... 3715924

[51] Int. Cl.[4] ..... H01J 40/14

[52] U.S. Cl. ..... 250/211 R; 313/261

[58] Field of Search ..... 313/538, 539, 621, 631, 313/632, 39, 261; 250/211 R, 372

[56] References Cited

U.S. PATENT DOCUMENTS

| | | | |
|---|---|---|---|
| 2,000,705 | 5/1975 | Long | 250/211 R |
| 2,103,031 | 12/1937 | Foulke | 313/631 |
| 2,237,242 | 4/1941 | Tykociner et al. | 250/211 R |
| 2,283,413 | 5/1942 | Cashman | 313/539 |
| 2,576,251 | 11/1951 | Cisne | 313/261 |
| 2,604,604 | 7/1952 | Elston | 313/261 |
| 3,244,890 | 4/1966 | Wittwer, Jr. | 250/211 R |
| 3,636,399 | 1/1972 | Eastman et al. | 313/346 |
| 3,809,939 | 5/1974 | Miram et al. | 313/39 |

FOREIGN PATENT DOCUMENTS 731755 6/1955 United Kingdom .

*Primary Examiner*—David C. Nelms
*Assistant Examiner*—William L. Oen
*Attorney, Agent, or Firm*—Carlo S. Bessone

[57] ABSTRACT

In a photocell, in particular for detecting U.V. radiation, comprising a plate cathode (1), an anode (2) and lead-in and lead-off lines (3, 4; 5, 6) respectively, which are sealed in a glass envelope, the plate cathode consists of a sheet metal strip (13) which, at its ends (11, 12), is connected to said lead-in lines (3, 4), while said anode consists of a wire electrode (16) which, at its ends (14, 15), is connected to said lead-off lines (5, 6) and which is arranged on the plate cathode side facing the radiation to be detected substantially parallel to and spaced apart (d) from said plate cathode. By this it is possible to achieve less overall costs of production and at the same time very good efficiency.

8 Claims, 10 Drawing Sheets

PHOTOCELL, HAVING INCLINED PLATE CATHODE

Figure 1:
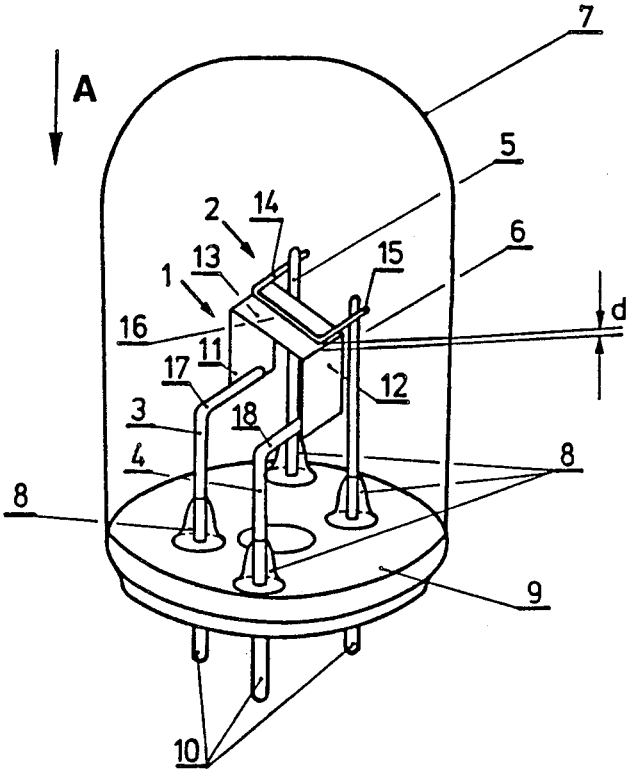

This invention relates to a photocell, in particular for detecting U.V. radiation, comprising a plate cathode, an anode and lead-in lines extending to the plate cathode as well as lead-off lines extending from the anode, which are sealed in a glass envelope. A photocell constitutes a photoelectric structural element and more specifically an electron tube in which the electrons are freed from the photocathode by irradiation and then are absorbed by the oppositely disposed anode. We discriminate between vacuum photocells and gas photocells. In both types, the photocurrent is proportional to the luminuous intensity of the irradiated light, based on the photocathode, further to the size of the effective surfacial area of the photocathode, while at the same time a constant luminuous intensity of the same is presupposed. An example of the application of such a photocell is e.g. such one for detecting flames or fire, respectively. If it is desired to detect U.V. radiation, then it is self-evident that the glass of the envelope of the photocell must be permeable to such radiation.

of this type is already known (DE-OS No. 1,564,073), wherein also the anode is a so-called plate anode, which, therefore, has a substantially plane metal surface. The use of a plate cathode as well as of a plate anode ensures a higher sensitivity of the photocell in a manner such that already smaller radiations as well can be detected and displayed because a plate anode exerts a more intense absorption effect than a wire anode. On the other hand, however, the electrode construction with respect to its fabrication is connected with particular effort and expenditure because of the necessary lengthy and costly working processes, since, for one thing, the plate anode must become a fine screen in a complicated photo-etching procedure, whereupon an individual polishing of either electrode must take place, while, for another thing, a complete utilization of the surface of the cathode presupposes an exact plane parallelism between the cathode and the anode, i.e. for practical utilization of the active surface of the cathode the parallelism must be secured in two coordinates. Thus the profitableness and marketability of this known photocell are naturally impaired. While it is true that these disadvantages can be avoided by using ordinary wire electrodes as anode as well as cathode since—for things are as they are—these electrodes are the least expensive and most profitable ones, one must nevertheless endure quite a considerable loss of sensitivity because, inevitably, when a wire is used then the cathode surface available for the irradiation, for one thing, and the anode surface available for the absorption, for another thing, are relatively small.

The problem underlying the present invention is seen in providing a photocell of the type mentioned in the first paragraph hereinabove, which ensures a good sensitivity in conjunction with an acceptable expenditure.

This problem is solved in accordance with the present invention in that the plate cathode consists of a sheet metal strip which, at its ends, is connected to said lead-in lines, while said anode consists of a wire electrode which, at its ends, is connected to said lead-off lines and which is arranged on the plate cathode side facing the radiation to be detected, substantially parallel to said plate cathode and spaced apart a distance from the latter.

Thus this invention combines the efficiency-based advantage of a plate cathode with the production technical and profitableness-based advantages of a wire anode, while in this connection it has turned out that the loss of sensitivity of the photocell according to the present invention as compared with that comprising a plate anode is less than it ought to be expected. This can be explained experimentally by the fact that in the known photocell comprising a plate cathode as well as a plate anode there a certain shading of the cathode by the anode takes place in a manner such that merely the radiation extending sidewise past the anode and obliquely incident on the plate cathode can be utilized by this cathode so that merely the plate cathode surface projected in the direction of the incident radiation will finally become effective. Thus in the known photocell there the actually existing full surface of the plate cathode is not utilizable. In contrast, in the photocell according to the present invention the wire anode does only little impair the incidence of radiation perpendicular to the plate cathode so that practically the entire surface of the plate cathode is available for the irradiation. In comparison with this, the smaller absorption effect of the wire anode as against that of a plate anode does obviously run short. Moreover, a particular advantage of the photocell according to the present invention resides in that this photocell has a good sensitivity within a wide range of different angles of incidence of the radiation, which sensitivity is only little lessened and remains also when the incident radiation is perpendicular to the plate cathode although in the case of such an angle of incidence perpendicular to the plate plane the wire anode disposed on the plate cathode side facing the radiation to be detected is causing a shading which, however, is negligible. Yet this effect is by far not comparable to that in the case of a plate anode wherein in the case of a radiation incidence perpendicular to the plate cathode this cathode is shaded to about 50%.

Furthermore, in the subject matter of the present invention there an exact parallelism must be secured, advantageously, only in one coordinate to thereby practically fully utilize the active surface of the cathode. Moreover, both the plate cathode and the wire anode can be conjointly polished in a single electrode polishing process which, too, enhances the profitability.

Some advantageous further developments of the invention are subject matters of the subclaims.

Figure 2:
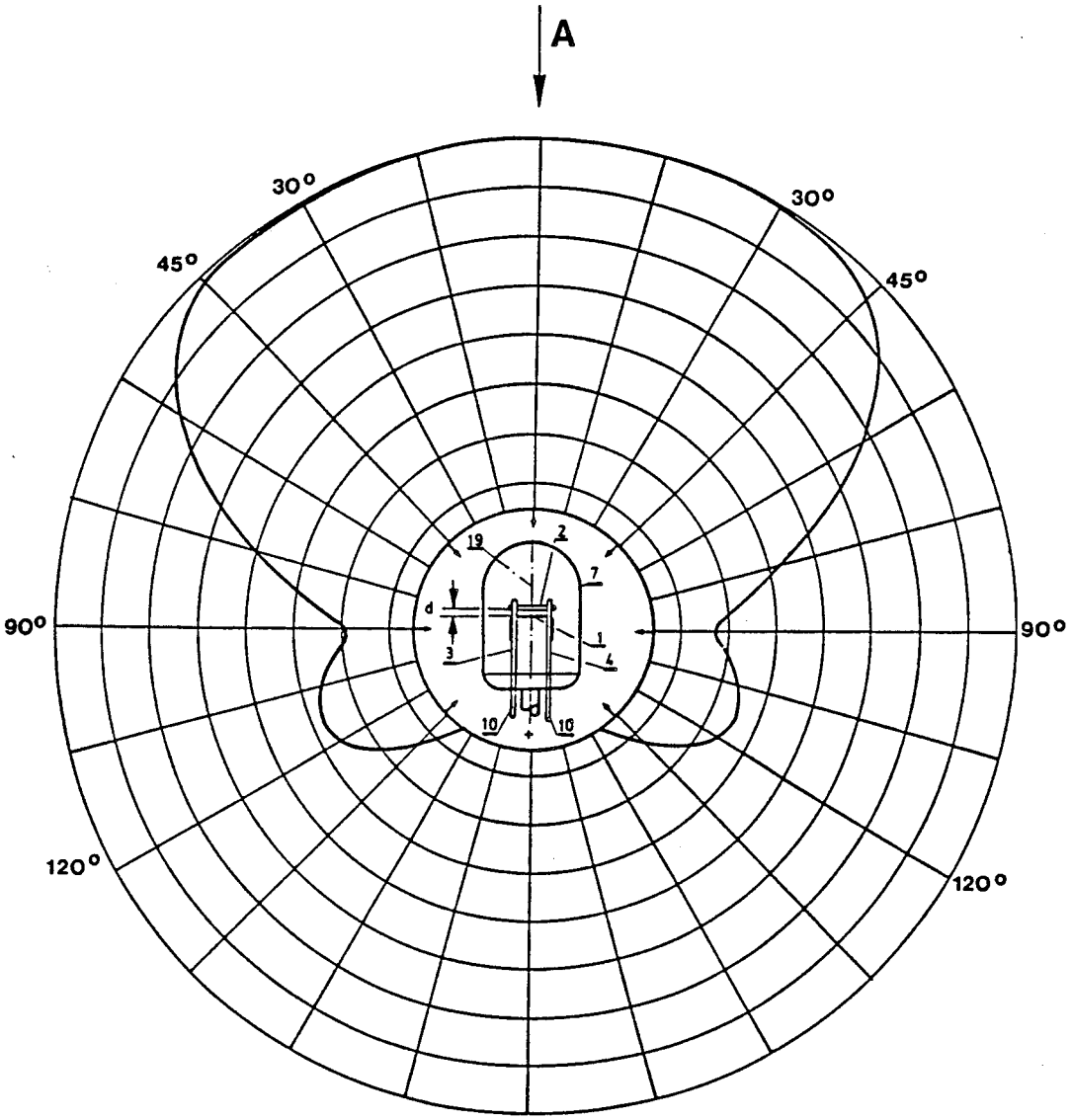
Figure 3:
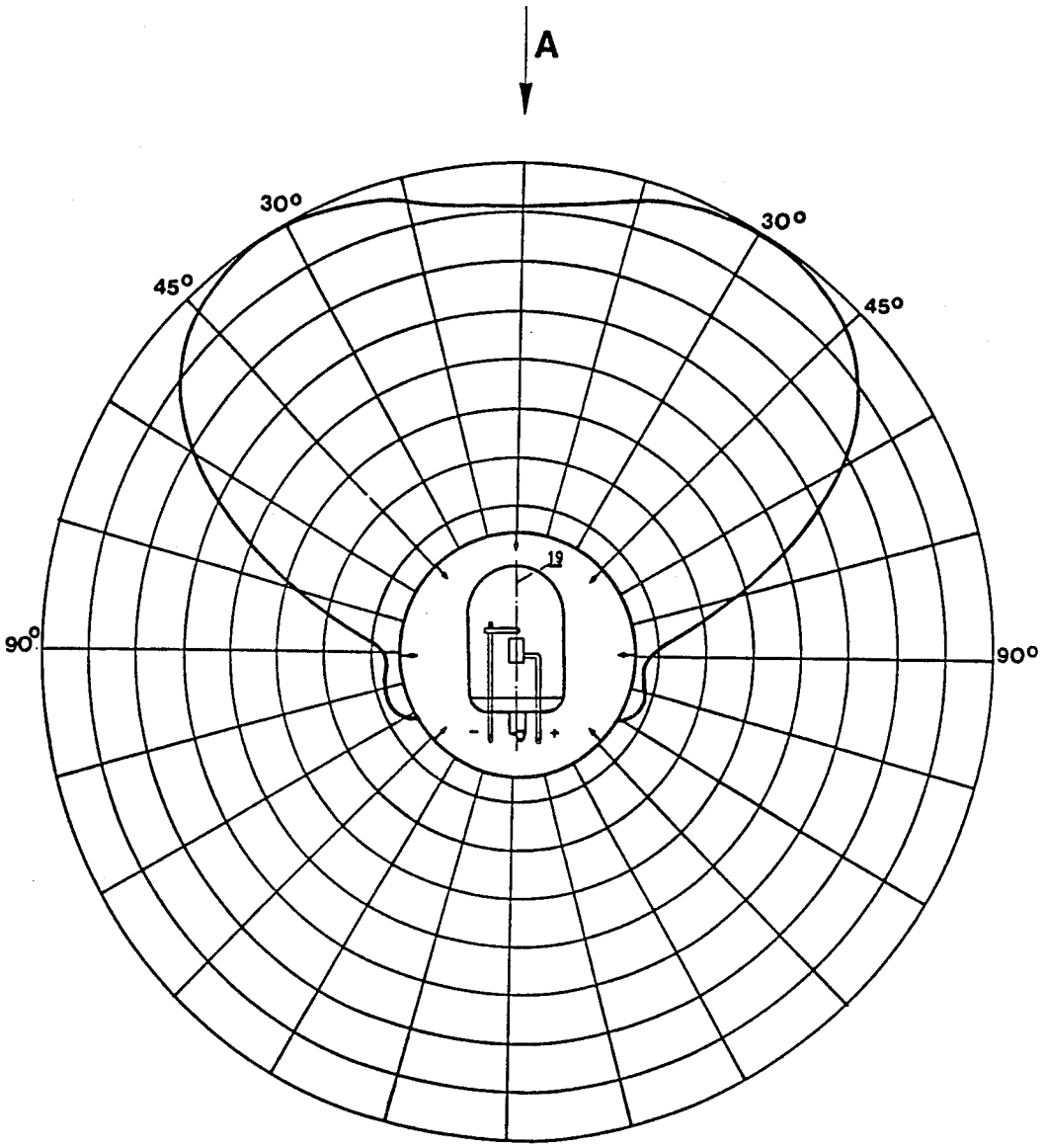
Figure 4:
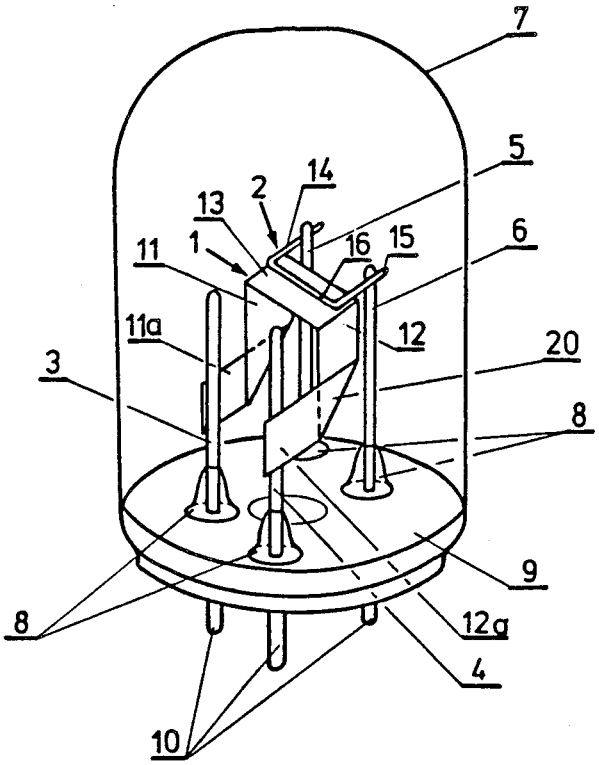
Figure 5:
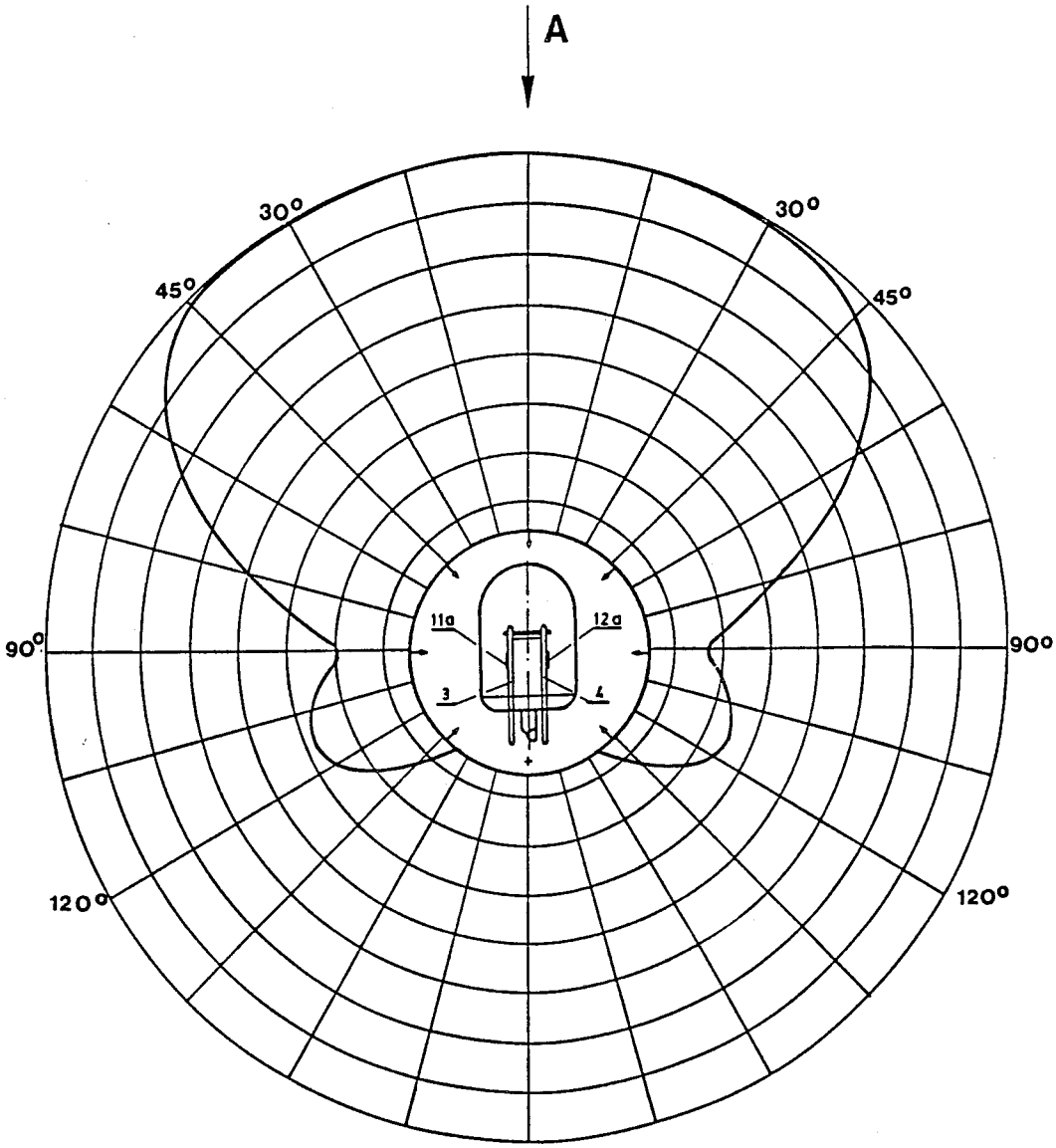
Figure 6:
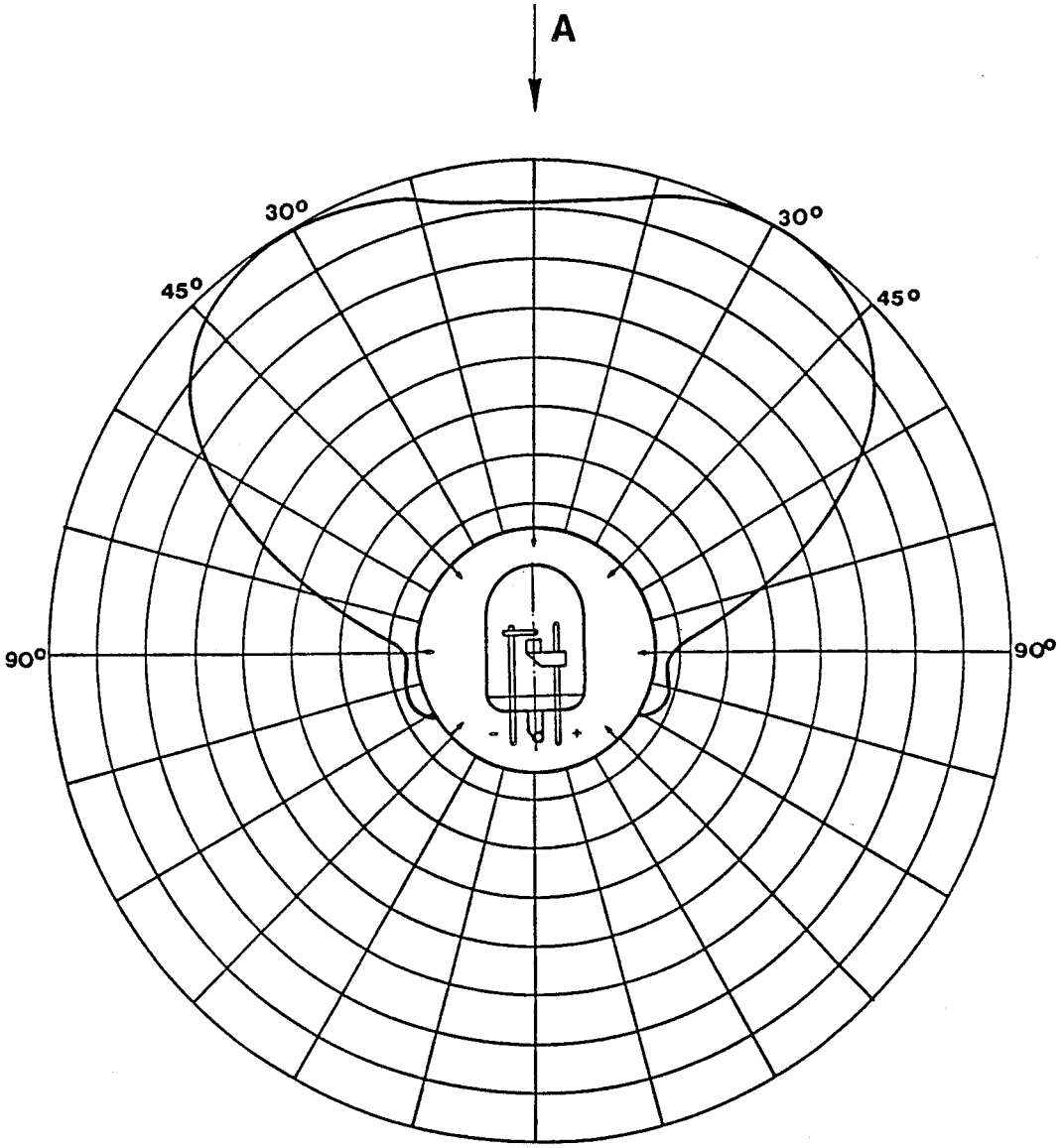
Figure 7:
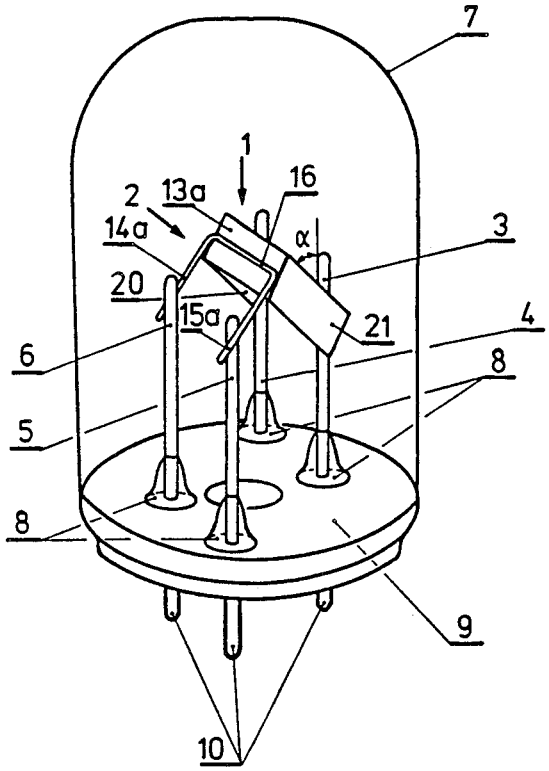
Figure 8:
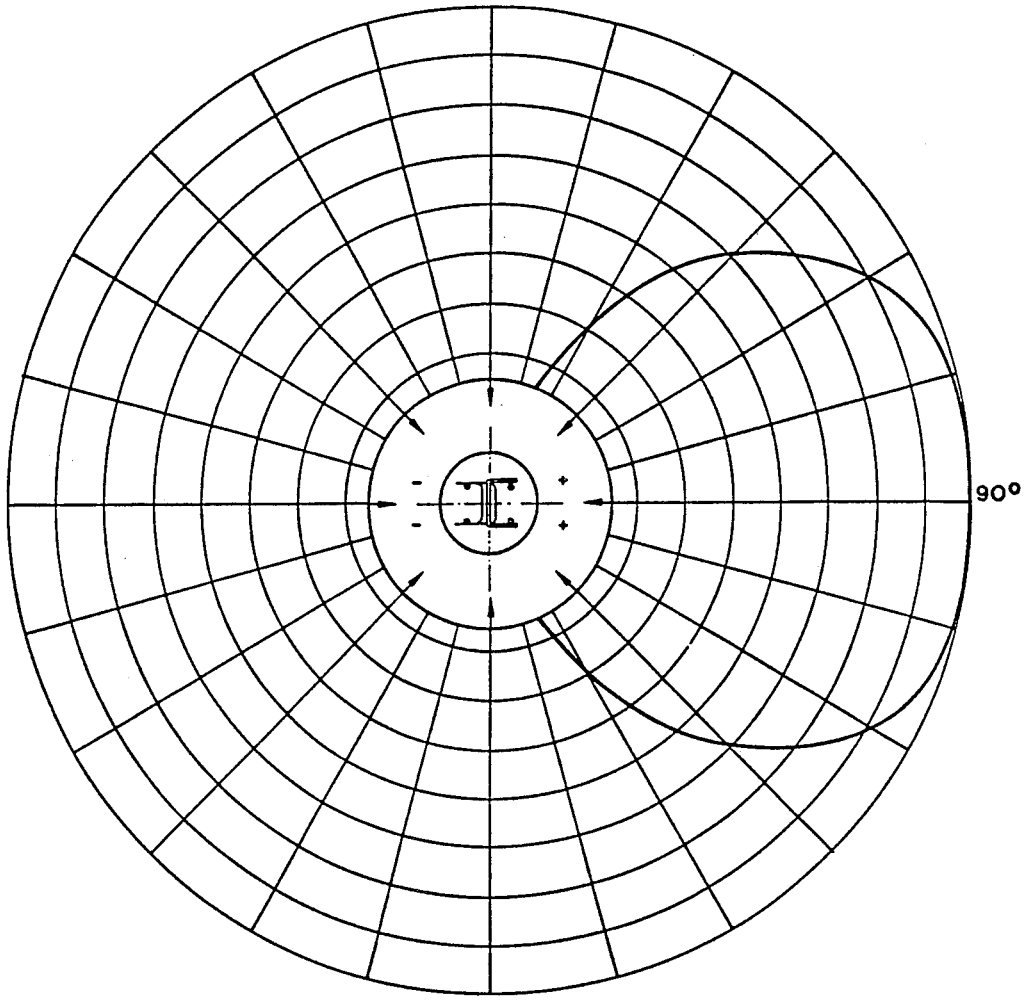
Figure 9:
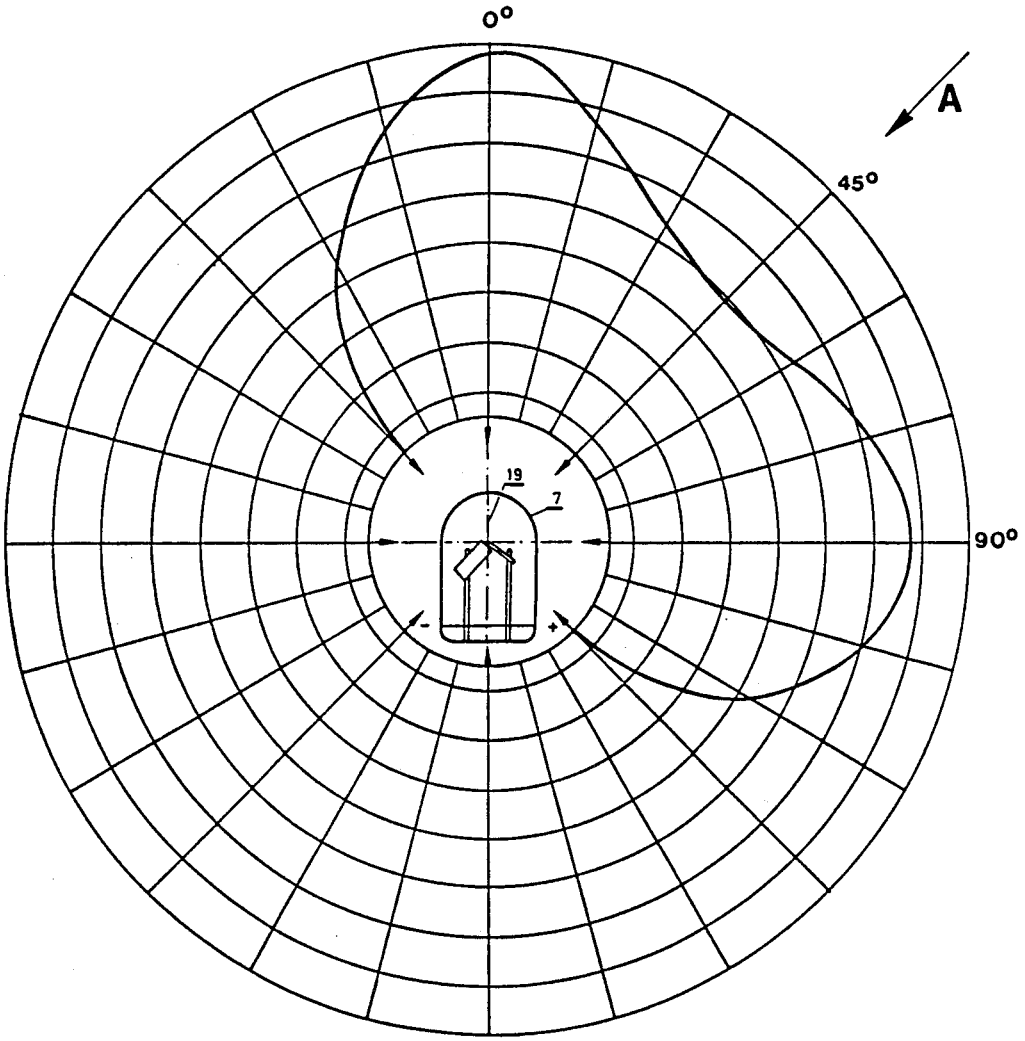
Figure 10:
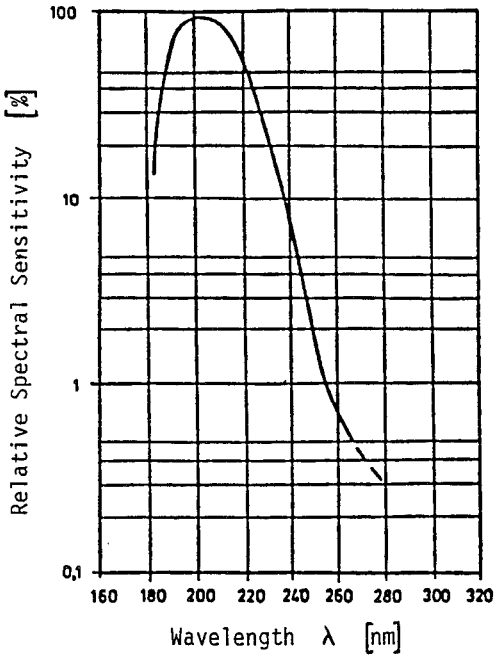

The invention is elucidated in greater detail hereinafter in the light of exemplary embodiments represented in the drawings, wherein FIG. 1 shows a first practical embodiment of the photocell in a schematic view, FIG. 2 shows the responsiveness and sensitivity respectively of the embodiment according to FIG. 1 in a longitudinal center plane containing the wire anode perpendicular to the plate cathode, FIG. 3 shows the responsiveness and sensitivity respectively of the embodiment according to FIG. 1 in a longitudinal center plane perpendicular to the plane according to FIG. 2, FIG. 4 shows a second embodiment of the photocell in a schematic view, FIG. 5 shows a diagram corresponding to FIG. 2 with respect to the responsiveness and sensitivity respectively of the embodiment according to FIG. 4, FIG. 6 shows a diagram corresponding to FIG. 3 with respect to the responsiveness and sensitivity respectively of the embodiment according to FIG. 4, FIG. 7 shows a third embodiment of the photocell in a schematic view, FIG. 8 shows a top plan view of the embodiment according to FIG. 7 in a diagram showing the responsiveness and sensitivity respectively in a horizontal plane intersecting the plate cathode, FIG. 9 shows a side view of the embodiment according to FIG. 7 and a surrounding diagram corresponding to FIGS. 3 and 6, and FIG. 10 shows a diagram showing the relative spectral sensitivity of the embodiment according to FIG. 7.

The photocell according to FIG. 1 comprises a plate cathode 1, an anode 2 and lead-in lines 3 and 4 extending to the plate cathode 1 as well as lead-off lines 5 and 6 extending from the anode 2, which are sealed in a glass envelope 7 and more specifically with heat-sealed feet 8 in the thickened base 9 of the glass envelope 7 through which the contact pins 10 are brought out as electrode connections; merely three such pins 10 protruding from the underside of said base 9 downwards are shown in the schematic view of FIG. 1. The plate cathode 1 according to the present invention consists of a sheet metal strip 13 which, at its ends, is connected to the lead-in lines 3 and 4. The anode 2 consists of a wire electrode 16 which, at its ends 14 and 15, is connected to said lead-off lines 5 and 6 and which is arranged on the plate cathode side facing the radiation to be detected, substantially parallel to said plate cathode 1 and spaced apart a distance d from the latter. The radiation to be detected is incident on the plate cathode 1 from above, hence generally in the arrow direction A. The lead-in lines 3, 4 and the lead-off lines 5, 6 respectively are, as shown here, heat-sealed within the base 9 of the glass envelope in a manner such that they extend substantially parallel to each other, while the plane of the sheet metal strip 13 constituting the cathode 1 is disposed parallel to said lines and its ends 11 and 12 are rectangularly bent for connection to the lead-in lines 3 and 4. These ends 11, 12 of the sheet metal strip 13 are each time once bent towards the base 9 of the glass envelope while the ends 17 and 18 of the lead-in lines 3 and 4 are each time once bent towards the lead-off lines 5, 6 substantially by 90°. Each one end 17 and 18 respectively of the lead-in lines is connected to each one respective end 11, 12 of the sheet metal strip, suitably by welding.

The responsiveness of this embodiment is shown in FIGS. 2 and 3 and more particularly corresponding to the depicted plane of section through the photocell according to FIG. 1. Each plane of section will be apparent in the light of the side view of this photocell shown in the center of the diagram. Thus, at a vertical radiation incidence from above corresponding to the arrow direction A, in the section there will result the greatest sensitivity in the arrow direction A with a side constancy up to about 30° toward either side and an only negligible decrease up to 45° with the minima to be expected at 90°, a renewed increase between 105° and 120° and a full decrease up to about 140°.

FIG. 3 shows the responsiveness in the case of different angles of incidence in a section perpendicular to that according to FIG. 2. It is to be noted right here that both planes of section are suitably longitudinal center planes, i.e. they contain the longitudinal axis 19 of the photocell according to FIG. 1 and accordingly, in the case of a central arrangement of the cathode as well as of the anode, they will intersect these each time in the middle.

In this sectional plane according to FIG. 3, the vertical radiation incidence in the arrow direction A shows no maximum but rather two maxima appear at about 30° with a subsequent decrease up to about 90°. The values above an angle of 90°—by the way, just as in the section according to FIG. 2—should be ignored. From both diagrams it will be apparent that very good responsiveness values are achieved with about 45° at either side of the vertical incidence perpendicular line (arrow A) of the radiation irrespective of the fact as to whether the section is made in the longitudinal direction of the anode 2 (FIG. 2) or perpendicular thereto (FIG. 3).

In the embodiment of a photocell according to the present invention as shown in FIG. 4 there equal members are provided with equal reference numerals as in the embodiment according to FIG. 1. The sole difference consists in that, for one thing, the lead-in lines 3 and 4 have no bent ends and in that, for another thing, the ends 11 and 12 of the sheet metal strip 13 of the plate cathode 1 are each buckled down along a 45°—line 20 and, by their end portions 11*a* and 12*a*, are abutting the lead-in lines 3 and 4 and are connected to these lines, again suitably by welding. Hence it follows that what is involved here is but a different configuration of the sheet metal strip 13 on the one hand and of the lead-in lines 3 and 4 on the other hand. It is quite evident that the responsiveness according to the FIGS. 5 and 6 does practically show no differences whatever over the responsiveness of the embodiment according to FIG. 1 corresponding to FIGS. 2 and 3.

A further, preferred practical embodiment is apparent from FIG. 7 wherein again equal members are provided with equal reference numerals. Also here the lead in lines and the lead-off lines 3, 4 and 5, 6 respectively are welded into the base 9 of the glass envelope so as to extend substantially parallel with respect to each other, whereas the plane of the sheet metal strip 13*a* constituting the cathode 1 is disposed obliquely to these lines while the ends 20, 21 thereof are bent in U-shape for connection to the lead-in lines 3, 4 just as in the case also of the embodiment according to FIG. 1. However, what is decisive is the apparent oblique arrangement according to the angle $\alpha$ between the lead-in lines 3, 4 and the ends 20 and 21. At the same time, the plane of the sheet metal strip 13*a* constituting the cathode 1 is disposed so as to be preferably inclined by about $\beta=45°$ with respect to the longitudinal axis 19 (FIG. 9) of the glass envelope 7. Also the ends 14*a* and 15*a* of the wire electrode 13*a* are in this case bent in a plane towards the lead-off lines 5, 6, which is inclined about 45° to the longitudinal axis 19 of the glass envelope 7, as is clearly shown in FIGS. 7 and 9. Due to the inclined arrangement of the electrodes, the photocell according to the embodiment shown in FIG. 7 is suited for a front radiation as well as for a side irradiation as is peculiarly clearly shown in FIG. 9. In this case, the vertical irradiation direction according to the arrow direction A is inclined by 45° relative to the longitudinal axis 19 of the photocell, when it is assumed that this longitudinal axis 19 is the 0°-direction of the radiation incidence. As is apparent, at 0° and at 90° one may find the respective sensitivity maxima. At the same time, the 0°-direction can be defined as the front irradiation while the 90°-direction can be defined as the side irradiation. FIG. 8 shows the sensitivity distribution in a horizontal section with the maximum at 90°. It stands to reason that a corresponding picture would result also for a not shown vertical section wherein the sectional plane would extend vertically on the plane of the drawing of FIG. 8 as well as on the plane of the drawing of FIG. 9 and it would contain the 0°-direction.

The inclination of the plate cathode opens the possibility to increase the area thereof by extending its boundaries towards the inner walls of the tube. As a consequence of doing this, the projection area in the direction of the longitudinal axis of the tube as well as perpendicular thereto is the same in both cases and corresponds to the area of a plate cathode arranged perpendicular to the longitudinal axis of a tube.

The arrangement of the plate cathode in accordance with FIG. 7 means equal sensitivity for both an angle of attack of the incident radiation parallel to the longitudinal axis of the tube and an angle of attack of incident radiation perpendicular to the longitudinal axis of the tube. If the area of the plate cathode is increased as taught above, the sensitivity should not be less than the sensitivity of a plate cathode being arranged perpendicular to the longitudinal axis of the tube.

Finally, FIG. 10 shows the relative spectral sensitivity of the embodiment according to FIG. 7 with a maximum at a wavelength of about $\lambda=200$ nm$\pm$10 nm with subsequent decrease up to about 190 to 280 nm. The service voltage amounted 300 V direct current, the burning voltage 180$\pm$15 Volt, the service current 2 mA, the quenching voltage 500 V, the maximum current 4 mA and the service temperature interval $-20°$ to $+90°$.

In all of the here elucidated embodiments there is advantageously resulting an almost hemispherical zone of greatest responsiveness and sensitivity respectively. As further advantages of the structural type according to the present invention it is to be pointed out that an electrolytic polish of the entire system is possible, whereas in the closest prior art the plate electrodes are treated individually.

Furthermore, according to the invention a cleaning glowing in high vacuum with current (e.g., direct current) passage is possible, whereas in the closest prior art an induction glowing is required. Both of the above-mentioned advantages represent a substantial cost advantage in manufacturing.

What is claimed is:

1. A photocell, in particular for detecting U.V. radiation, comprising a plate cathode (1), an anode (2) and lead-in and lead-off lines (3, 4, 5, 6) respectively, which are sealed in a glass envelope, the plate cathode (1) consisting of a sheet metal strip (13) which, at its ends (20, 21), is connected to said lead-in lines (3, 4), while said anode (2) consists of a wire (16) which, at its ends (14, 15), is connected to the lead-off lines (5, 6) and which is arranged on the plate cathode side facing the radiation to be detected, substantially parallel to said plate cathode and spaced apart a distance (d) from the latter, characterized in that the plane of the sheet metal strip (13) constituting the cathode (1) is disposed at an angle of inclination with respect to the longitudinal axis (19, FIG. 3) of the glass envelope (7).

2. The photocell according to claim 1, characterized in that the angle of inclination is 45 degrees.

3. The photocell according to claim 1, characterized in that both ends (20, 21) of the sheet metal strip (13) forming the cathode (1) s well as the ends (14, 15) of the wire (16) forming the anode (2) are each time once bent towards the lead-in lines (3, 4) and the lead-off lines (5, 6), respectively, and are connected to these lines in a manner such that the cathode (1) and the anode (2) are disposed opposite each other substantially in a plane (22, FIG.3) being centrally and perpendicularly arranged with respect to the sheet metal strip (13).

4. The photocell according to claim 1, characterized in that the lead-in lines and the lead-off lines (3, 4, 5, 6 respectively) are welded into the base (9) of the glass envelope so as to extend substantially parallel with respect to each other, and in that the plane of the sheet metal strip (13) constituting the cathode (1) is disposed obliquely to these lines.

5. The photocell according to claim 1, characterized in that also the ends (14, 15) of the wire anode (16) are bent towards the lead-off lines (5, 6) in a plane which is inclined by about 45 degrees with respect to the longitudinal axis (19) of the glass envelope (7).

6. A method of manufacturing a photocell for detecting U.V. radiation, comprising the steps of providing a plate cathode (I) consisting of a sheet metal strip (13) which, at its ends (11, 12), is connected to lead-in lines (3, 4); providing an anode (2) consisting of a wire electrode (16) which, at its ends (14, 15) is connected to the lead-off lines (5, 6) and which is arranged on the plate cathode side facing the radiation to be detected; electropolishing the anode and cathode conjointly; and sealing the lead-in lines, lead-off lines, plate cathode and anode in a glass envelope (7).

7. The method of manufacturing a photocell in accordance with claim 6 including the step of annealing the whole system including anode and cathode conjointly by current passage in high vacuum.

8. The method of manufacturing a photocell in accordance with claim 6 further including the step of annealing the whole system including anode and cathode conjointly by the passsage of direct current in high vacuum.

* * * * *